United States Patent [19]

Pollet et al.

[11] 4,132,551

[45] Jan. 2, 1979

[54] HIGH TEMPERATURE PROCESSING OF PHOTOGRAPHIC SILVER HALIDE MATERIAL

[75] Inventors: Robert J. Pollet, Vremde; Robrecht J. Thiers, Brasschaat; Theofiel H. Ghys, Kontich; Antoon L. Vandenberghe, Hove; Herman A. Philippaerts, Edegem; Hubert Vandenabeele, Mortsel, all of Belgium

[73] Assignee: AGFA-GEVAERT N.V., Mortsel, Belgium

[21] Appl. No.: 541,123

[22] Filed: Jan. 15, 1975

Related U.S. Application Data

[63] Continuation of Ser. No. 289,094, Sep. 14, 1972, abandoned.

[51] Int. Cl.[2] ..... G03C 5/30

[52] U.S. Cl. ..... 96/66.5; 96/109

[58] Field of Search ..... 96/109, 66.5

[56] References Cited

U.S. PATENT DOCUMENTS

| | | | |
|---|---|---|---|
| T878,010 | 9/1970 | Beavers | 96/109 |
| 2,776,211 | 1/1957 | Allen et al. | 96/109 |
| 3,140,178 | 7/1964 | Herz et al. | 96/109 |
| 3,573,915 | 4/1971 | Luciani et al. | 96/109 |
| 3,832,179 | 8/1974 | Edens | 96/22 |

*Primary Examiner*—J. Travis Brown

*Attorney, Agent, or Firm*—A. W. Breiner

[57] ABSTRACT

A method for producing photographic images by development of an exposed silver halide element at elevated temperature is provided wherein the development occurs in the presence of a non-quaternary, non-heterocyclic nitrobenzene compound of the formula:

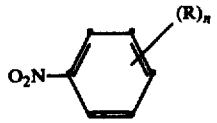

wherein:

$(R)_n$ stands for one or more substituents selected from hydrogen, halogen, alkyl, substituted alkyl, alkenyl, substituted alkenyl, alkynyl, substituted alkynyl, alkoxy, substituted alkoxy, alkylmercapto, substituted alkylmercapto, amino, substituted amino, aryl, substituted aryl, hydroxy, nitro, cyano, sulpho or carboxy in acid or salt form, alkoxycarbonyl and an acyl group derived from a carboxylic or sulphonic acid.

The nitrobenzene compounds have a favorable effect on the sensitometric properties of the silver halide emulsion that are developed at elevated temperature. They reduce the supplemental fog produced by development at elevated temperature.

6 Claims, No Drawings

HIGH TEMPERATURE PROCESSING OF PHOTOGRAPHIC SILVER HALIDE MATERIAL

This is a continuation of application Ser. No. 289,094 filed Sept. 14, 1972, now abandoned.

The present invention relates to development at increased temperature of exposed photographic radiation sensitive silver halide elements.

In normal processing of exposed photographic materials development is carried out at ambient temperature (about 20° C) and requires a relatively long time say several minutes. Therefore, there is a general trend to enhance the speed of processing, which can be done by carrying out development and the other processing operations at elevated temperatures. Rapid development of photographic elements occurs at temperatures above 30° C and preferably between 35 and 45° C.

When the processing of exposed photographic silver halide elements is carried out at elevated temperatures, i.e., above 30° C these elements have a tendency of showing increased fog and generally the other sensitometric characteristics are impaired also.

It is known to reduce the formation and growth of fog in photographic silver halide elements by means of antifoggants or stabilizers, e.g., heterocyclic mercapto compounds such as 1-phenyl-5-mercapto-tetrazole and azaindenes, more particularly tetra- or pentaazaindenes, especially those substituted by hydroxy or amino groups, e.g., 5-methyl-7-hydroxy-s-triazolo-[1,5-a]pyrimidine. The latter compounds are used to stabilize the emulsion against formation and growth of fog when the photographic materials are stored before use. The compounds have only a relatively weak effect in reducing fog formation when the photographic materials are used immediately after preparation. 1-Phenyl-5-mercapto-tetrazole, on the contrary, has a high fog reducing effect immediately after the preparation of the photographic emulsions. Therefore, both compounds are generally used together in the emulsion.

However, the supplemental fog produced by the processing at elevated temperatures cannot be reduced sufficiently by means of the conventional antifoggants or stabilizers.

It has now been found that non-quaternary, non-heterocyclic nitrobenzene compounds have a favorable effect on the sensitometric characteristics, i.e., fog and/or speed and/or gradation of light-sensitive silver halide emulsions, which after exposure are processed at elevated temperature. They generally reduce the supplemental fog formed without reducing the emulsion speed to a notewrothy extent or even in some cases with an increase of the emulsion speed. Other compounds give rise to an increase of the speed and/or the gradation without showing a noteworthy influence on the fog.

Particularly suitable nitrobenzene compounds can be represented by the formula:

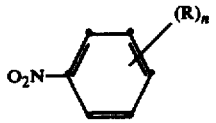

wherein:

$(R)_n$ stands for one or more substituents selected from hydrogen, halogen, alkyl including substituted alkyl, alkenyl including substituted alkenyl, alkynyl including substituted alkynyl, alkoxy including substituted alkoxy, alkylmercapto including substituted alkylmercapto, amino including substituted amino, e.g., alkylamino and arylamino, aryl including substituted aryl, hydroxy, nitro, cyano, sulpho or carboxy in acid or salt form, alkoxycarbonyl, and an acyl group derived from a carboxylic or sulphonic acid.

Thus, the present invention provides a method of producing photographic images, which comprises developing an exposed photographic element comprising a support and at least one photographic silver halide emulsion, at a temperature above 30° C wherein the said development is carried out in the presence of at least one nitrobenzene compound, particularly a nitrobenzene compound corresponding to the above general formula.

The nitrobenzene compounds of use according to the invention are particularly useful in photographic silver halide materials, which are stabilized against formation and growth of fog by means of azaindene compounds as described above and therefore the present invention also provides light-sensitive silver halide materials, which comprise an azaindene stabilizer, especially 5-methyl-7-hydroxy-s-triazolo-[1,5-a]pyrimidine, and a nitrobenzene compound, especially a nitrobenzene compound corresponding to the above general formula.

The following are representative examples of nitrobenzene compounds which were found particularly suitable for use according to the present invention. Where deemed necessary, literature references are given as to the preparation of the compounds:

1. nitrobenzene
2. m-dinitrobenzene
3. p-dinitrobenzene Org.Syn. Coll.Vol. 2, 225 (1943)
4. 2,4-dinitrobenzene sulphonic acid sodium salt H.E.Fiertz-David and L.Blangey "Grundlegende Operationen der Farbenchemie" p. 99, Springer Verlag, Wien, 1952.
5. 2-benzoylvinyl-4-nitrophenol
6. 1,2,3-trinitro-4,5-dimethoxybenzene J.Org.Chem.8, 331 (1943)
7. N-methyl-2,4-dinitroaniline J.Chem.Soc. 127, 41
8. p-nitrobenzonitrile Org.Syn.Coll.Vol. 3, 646
9. 2-nitroacetophenone Org.Syn.Coll.Vol. 4, 708
10. 4-nitrophthalic acid Org.Syn.Coll.Vol. 1, 399
11. 2-carboxymethylthio-nitrobenzene
12. 4-carboxyethynyl-nitrobenzene J.Chem.Soc. 1928, 429
13. 4-pentadecyl-1,3-dinitrobenzene C.A. 54, 18434
14. 4-n-hexadecylthio-1,3-dinitrobenzene
15. 4-n-hexadecyloxy-1,3-dinitrobenzene
16. 4,4'-dinitro-biphenyl J.Chem.Soc. 1929, 494

Compound 5 was prepared as follows:

To a solution of 20 g (0.5 mole) of sodium hydroxide in 150 ml of water and 250 ml of ethanol, 34 g (0.2 mole) of 5-nitrosalicylaldehyde and 24 g (0.2 mole) of acetophenone were added at room temperature. After 24 hours, the precipitate was filtered off by suction and then dissolved in water. After acidification with acetic acid the precipitate formed was recrystallized from benzene.

Yield: 35 g (65%). Melting point: above 200° C.

Compound 14 was prepared as follows:

To a solution of 183 g (0.9 mole) of 2,4-dinitro chlorobenzene and 232 g (0.9 mole) of n-hexadecylmercaptan in 1500 ml of ethylene glycol monomethyl ether, 50 g (0.47 mole) of sodium carbonate were added with stirring. The mixture was refluxed for 3 hours and then cooled. The precipitate formed was filtered off by suction, washed with water and dried.

Yield: 356 g (93%). Melting point: 97° C.

Compound 15 was prepared as follows:

To a solution of 184 g (1 mole) of 2,4-dinitrophenol and 305 g (1 mole) of n-hexadecylbromide in 1500 ml of ethylene glycol monomethyl ether 53 g (0.5 mole) of sodium carbonate were added with stirring. The mixture was refluxed for 16 hours whereupon the precipitate formed at room temperature was filtered off by suction and stirred with water. The precipitate was dried and recrystallized from ethanol.

Yield: 221 g (54%). Melting point: 64° C.

While the nitrobenzene compounds used in accordance with the present invention may be present in any of the water-permeable colloid layers of the photographic material, which are in water-permeable relationship with the silver halide emulsion layer, e.g., a gelatine anti-stress layer, an intermediate layer, a filter layer, etc., it is a particularly useful form of the invention to incorporate the nitrobenzene compounds into the silver halide emulsion itself.

The preparation of the silver halide emulsions involves three separate operations:

(1) the emulsification and digestion or ripening of the silver halide, (2) the freeing of the emulsion from water-soluble salts usually by washing, and (3) the second digestion or after ripening (chemical ripening) to obtain increased sensitivity.

The compounds of use according to the present invention can be added to the emulsion during no matter what step of emulsion preparation, preferably just before the coating of the emulsion of the emulsion on a suitable support, e.g., paper, glass or film such as cellulose triacetate and polyethylene terephthalate.

The compounds of the above general formula can be used with any type of light-sensitive material that after exposure is intended to be processed at elevated temperature. Various silver salts can be used as light-sensitive salt, e.g., silver bromide, silver iodide, silver chloride or mixed silver halides, e.g., silver chlorobromide or silver bromoiodide. They are particularly valuable to improve the fog on rapid processing at elevated temperature of medium or high-speed image forming silver halide emulsions, in which the silver halide is predominantly silver bromide, e.g., silver bromoiodide emulsions, the iodide content of which is less than 10 mole %.

The silver halides are dispersed in the common hydrophilic colloids such as gelatin, casein, zein, polyvinylalcohol, carboxymethyl cellulose, alginic acid, etc., gelatin being, however, favored.

The silver halide emulsions for being processed after exposure at elevated temperature generally are silver halide emulsions having a low content of hydrophilic colloid, e.g., gelatin. The ratio of hydrophilic colloid, more particularly gelatin, to silver halide expressed as silver nitrate is generally comprised between 0.2 and 0.6.

The compounds corresponding to the above general formula may be used in amounts varying between very wide limits. The optimum amount for each individual compound can be easily determined by some simple test known to those skilled in the art. In the silver halide emulsion they are generally employed in amounts comprised between 1 mg and 1000 mg per mole of silver halide.

The silver halide emulsions can be sensitized chemically as well as spectrally.

They can be sensitized chemically by any of the accepted procedures. The emulsions can be digested with naturally active gelatin or sulphur compounds, e.g., allyl thiocyanate, allyl thiourea, sodium thiosulphate, etc. The emulsions can be sensitized also by means of reductors, for instance tin compounds as described in U.K. patent specification No. 789,823 and by means of small amounts of noble metal compounds, e.g., of gold, platinum, palladium, iridium, ruthenium, and rhodium as described by R. Koslowsky, Z. Wiss. Phot. 46, 67–72 (1951). Representative noble metal compounds are ammonium chloropalladate, potassium chloroplatinate, potassium chloroaurate, and potassium aurithiocyanate. Of course, the emulsions can also be sensitized chemically with a combination of the above chemical sensitizers.

The emulsions may further comprise compounds that sensitize the emulsion by development acceleration, e.g., alkylene oxide polymers. These alkylene oxide polymers may be of various type, e.g., polyethylene glycol having a molecular weight of 1500 or more, alkylene oxide condensation products or polymers as described in U.S. Pat. Nos. 1,970,570; 2,240,472; 2,423,549; 2,441,389; 2,531,832 and 2,533,990 and in United Kingdom patent specification Nos. 920,637; 940,051; 945,340; 991,608 and 1,015,023. These development accelerating compounds may also be present in the silver halide developing solution. Other development accelerating compounds are onium and polyonium compounds preferably of the ammonium, phosphonium and sulphonium type.

The emulsions can be sensitized spectrally, e.g., by means of the common methine dyes such as neutrocyanines, basic or acid carbocyanines, rhodacyanines, hemicyanines, styryl dyes, oxonol dyes and the like.

Such spectrally sensitizing dyes have been described by F. M. Hamer in "The cyanine dyes and related compounds" (1954).

The common emulsion stabilizers or antifoggants can be added to the silver halide emulsions or the developing solution. Known antifoggants or stabilizers are, e.g., sulphinic and selenic acids or salts thereof, aliphatic, aromatic or heterocyclic mercapto compounds or disulphides, e.g., benzothiazoline-2-thione and 1-phenyl-5-mercaptotetrazole, which may comprise sulpho groups or carboxyl groups, nitroindazole, nitrobenztriazole, nitrobenzimidazole mercury compounds e.g. those described in Belgian Pat. Nos. 524,121; 677,337; 707,386 and 709,195 and as already noted above azaindenes, particularly the tetra- or pentaazaindenes and especially those substituted by hydroxy- or amino groups as described by Birr in Z. Wiss. Phot. 47, 2–58 (1952).

Other addenda, e.g., hardening agents such as formaldehyde, mucochloric and mucobromic acid, dialdehydes, etc. wetting agents, e.g., the fluorinated surfactants of U.K. patent application No. 58431/68, plasticizers, matting agents, e.g., polymethyl methacrylate and silica particles, colour couplers, mask-forming compounds, light-screening dyes, etc., may be present in the silver halide emulsion or another layer of the light-sensitive materials of the invention.

The following examples illustrate the present invention.

EXAMPLE 1

A silver bromoiodide X-ray emulsion ready for coating comprises per kg an amount of silver halide corresponding to 190 g of silver nitrate, 74 g of gelatin, 545 mg of 5-methyl-7-hydroxy-s-triazolo[1,5-a]pyrimidine, 6.5 mg of 1-phenyl-5-mercaptotetrazole, and 0.45 mg of mercury cyanide.

The above emulsion was divided into several aliquot portions and to each of these portions one of the nitrobenzene compounds listed in the table below was added in the amount given.

The emulsion portions were coated on a polyethylene terephthalate support and dried.

After exposure through a continuous wedge with constant 0.15 the emulsions were processed in an automatic 90 seconds processing machine. Development occurred for 23 seconds at 35° C in Agfa-Gevaert's hardening developer for automatic machine-processing G 138 which comprises hydroquinone and 1-phenyl-3-pyrazolidinone as developing agents and glutaraldehyde as hardener.

The sensitometric results obtained with the fresh materials and with materials that were stored before exposure and processing for 5 days at 45° C and 70% relative humidity are listed in the table below. The values given for the speed are relative values measured at density 1 above fog; a value of 100 has been given to the speed of the fresh material comprising no nitrobenzene compound.

Table

| mg nitrobenzene compound per kg emulsion | Fresh material | | | Stored material | | |
|---|---|---|---|---|---|---|
| | Fog | Gamma | Speed | Fog | Gamma | Speed |
| — | 0.05 | 1.50 | 100 | 0.06 | 1.22 | 112 |
| 10 mg of compound 3 | 0.03 | 1.60 | 77 | 0.03 | 1.12 | 102 |
| 100 mg of compound 3 | 0.01 | 1.76 | 48 | 0.02 | 1.10 | 112 |
| 10 mg of compound 6 | 0.03 | 1.72 | 77 | 0.03 | 1.18 | 105 |
| 100 mg of compound 6 | 0.03 | 2.12 | 69 | 0.03 | 1.08 | 91 |
| 10 mg of compound 12 | 0.02 | 1.48 | 81 | 0.03 | 1.14 | 98 |
| 100 mg of compound 12 | 0.05 | 1.68 | 83 | 0.04 | 1.16 | 112 |

The above results show that the compounds used according to the invention reduce fog-formation in photographic silver halide elements that are processed at elevated temperature. Moreover, the speed values obtained with the stored materials show that the compounds do not lower the sensitivity.

EXAMPLE 2

Example 1 was repeated with the difference that the nitrobenzene compounds listed in the following table were used.

Table

| mg nitrobenzene compound per kg emulsion | Fresh material | | | Stored material | | |
|---|---|---|---|---|---|---|
| | Fog | Gamma | Speed | Fog | Gamma | Speed |
| — | 0.20 | 1.68 | 100 | 0.22 | 1.40 | 102 |
| 10 mg of compound 4 | 0.16 | 1.63 | 86 | 0.17 | 1.34 | 89 |
| 100 mg of compound 4 | 0.17 | 1.65 | 89 | 0.16 | 1.30 | 89 |
| 10 mg of compound 16 | 0.17 | 1.51 | 79 | 0.18 | 1.23 | 86 |
| 100 mg of compound 16 | 0.15 | 1.51 | 81 | 0.15 | 1.16 | 75 |

The above results show the fog-reducing effect of the nitrobenzene compounds. It is also shown that the speed of the stored materials is not reduced to a noteworthy extent by the presence of the nitrobenzene compounds.

EXAMPLE 3

Emulsion portions were prepared as described in example 1. To each of the emulsion portions one of the nitrobenzene compounds listed in the table below were added in the amount given.

The emulsion portions were coated on both sides of a polyethylene terephthalate support, dried, and covered with a gelatin antistress layer.

After exposure and development as described in Example 1 the following sensitometric results were obtained.

| mg nitrobenzene compound per kg emulsion | Fresh material | | | | Stored material | | | |
|---|---|---|---|---|---|---|---|---|
| | Fog | Gamma | Speed | Max.density | Fog | Gamma | Speed | Max.density |
| — | 0.28 | 2.80 | 100 | 3.50 | 0.24 | 2.06 | 95 | 2.65 |
| 10 mg of compound 10 | 0.16 | 3.14 | 70 | 3.50 | 0.16 | 2.27 | 89 | 2.74 |
| 10 mg of compound 14 | 0.16 | 3.24 | 73 | 3.50 | 0.18 | 2.27 | 81 | 2.75 |
| 10 mg of compound 15 | 0.16 | 3.14 | 73 | 3.50 | 0.16 | 2.27 | 86 | 2.80 |

The above results show that compounds 10, 14, and 15 have a favourable effect on the fog, gradation, and maximum density. It is also shown that the speed of the stored materials is not reduced to a noteworthy extent.

EXAMPLE 4

A silver bromoiodide emulsion (1.5 mole % iodide) for oscillographic recording wherein the ratio of gelatin to silver halide (expressed as silver nitrate) is 0.5 and which comprises a spectrally sensitizing merocyanine dye as well as 5-methyl-7-hydroxy-s-triazolo[1,5-a]pyrimidine as emulsion stabilizer was divided into two aliquot portions. To one of these portions 50 mg of compound 3 were added per 100 g of silver nitrate used in the emulsion preparation.

The emulsion portions were then coated on a support and dried.

Strips of the materials formed were exposed and developed for 8 min. at 20° C or for 2 min. at 35° C in Agfa-Gevaert's developer G 150, which is a 1-phenyl-3-pyrazolidinone/hydroquinone developer.

The sensitometric results obtained are listed in the following table. The values given for the speed are relative values corresponding with density 1 above fog. For the speed of the comparison material, to which no nitrobenzene compound is added, a value of 100 is given.

Table

| | Development for 8 min. at 20° C | | | Development for 2 min. at 35° C | | |
|---|---|---|---|---|---|---|
| Material | Fog | Gamma | Speed | Fog | Gamma | Speed |
| comparison material comprising compound 3 | 0.09 | 2.12 | 100 | 0.13 | 2.54 | 100 |
| | 0.06 | 2.28 | 98 | 0.10 | 2.50 | 91 |

We claim:

1. Method of producing photographic images which comprises developing an exposed photographic element comprising a support and at least one photographic silver halide emulsion, at a temperature above 30° C., wherein the said development is carried out in the presence of at least one non-quaternary, non-heterocyclic nitrobenzene compound corresponding to the formula:

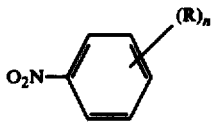

wherein:

$(R)_n$ stands for one or more substituents selected from hydrogen, a halogen atom, an alkyl group, an alkenyl group, an alkynyl group, an alkoxy group, an alkylmercapto group, an amino group, an aryl group, hydroxy, nitro, cyano, sulpho or carboxy in acid or salt form, alkoxycarbonyl and an acyl group derived from a carboxylic or sulphonic acid.

2. Method according to claim 1 wherein the said nitrobenzene compound is present in the silver halide emulsion.

3. Method according to claim 2 wherein the said nitrobenzene compound is present in an amount comprised between 1 mg and 1000 mg per mole of silver halide.

4. Method according to claim 1 wherein the nitrobenzene compound is m- or p-dinitrobenzene, 2,4-dinitrobenzene sulphonic acid in acid or salt form, 4-nitrophthalic acid or 4,4'-dinitro-biphenyl.

5. Method according to claim 1 wherein the emulsion comprises an azaindene emulsion stabilizer.

6. Method according to claim 5 wherein said azaindene emulsion stabilizer is 5-methyl-7-hydroxy-s-triazolo[1,5-a]pyrimidine.

* * * * *

UNITED STATES PATENT AND TRADEMARK OFFICE

CERTIFICATE OF CORRECTION

PATENT NO. : 4,132,551

DATED : January 2, 1979

INVENTOR(S) : Robert J. Pollet et al

It is certified that error appears in the above-identified patent and that said Letters Patent are hereby corrected as shown below:

In the heading, insert the priority data:

[30] Sept. 17, 1971 [GB] United Kingdom 43,517/71

Column 1, line 52, "notewrothy" should read -- noteworthy --;

Column 3, line 19, "gelatine" should read -- gelatin --;

Column 3, line 35, "of the emulsion" (second occurrence) should be deleted; and

Column 4, line 26, "1,970,570" should read -- 1,970,578 --.

Signed and Sealed this

*Twelfth* Day of *February 1980*

[SEAL]

*Attest:*

SIDNEY A. DIAMOND

*Attesting Officer*

*Commissioner of Patents and Trademarks*